United States Patent [19]

Zirbel

[11] 3,967,581

[45] July 6, 1976

[54] APPARATUS FOR APPLYING A COATING TO A WORKPIECE EDGE

[76] Inventor: Irvin Edward Zirbel, 11727 W. Dorothy St., Los Angeles, Calif. 90049

[22] Filed: Aug. 2, 1973

[21] Appl. No.: 384,907

Related U.S. Application Data

[63] Continuation-in-part of Ser. No. 159,783, July 6, 1971, abandoned.

[52] U.S. Cl. ..... 118/2; 118/410

[51] Int. Cl.[2] ..... B05C 5/02

[58] Field of Search ..... 118/410, 411, 415, 413, 118/2, 8, 25, 100; 401/48, 193; 425/87

[56] References Cited

UNITED STATES PATENTS

| | | | |
|---|---|---|---|
| 1,801,573 | 4/1931 | Salerno | 118/25 |
| 2,065,298 | 12/1936 | Abbott | 118/415 X |
| 2,402,310 | 6/1946 | Beaumier | 401/193 |
| 2,620,767 | 12/1952 | Lehman | 118/2 |
| 2,625,085 | 1/1953 | Bergstein | 118/2 X |
| 2,683,981 | 7/1954 | Richey | 401/193 X |
| 3,052,565 | 9/1962 | Chenn et al. | 118/411 X |
| 3,071,106 | 1/1963 | Burelbach et al. | 118/2 |
| 3,332,580 | 7/1967 | Spencer et al. | 118/411 X |
| 3,348,519 | 10/1967 | Dyess, Jr. et al. | 118/2 |
| 3,362,379 | 1/1968 | Knudtson | 118/8 |
| 3,595,203 | 7/1971 | Fabulich | 118/2 |
| 3,669,064 | 6/1972 | Huelzinger et al. | 118/50 X |
| 3,807,351 | 4/1974 | Tuberman | 118/410 X |

*Primary Examiner*—John P. McIntosh
*Attorney, Agent, or Firm*—Henry M. Bissell

[57] ABSTRACT

Apparatus for finishing the edge of particleboard, plywood and the like by smoothing and sealing the edge with a fast-drying material providing a firm base on which a woodgrain pattern or the like may be printed. The finish developed by extruding and shaping a fast-drying material to a thickness of approximately 5/1000 inch along the edge of the board. Switches are employed to precisely control the application of material when the board is in the vicinity of the applicator. A heating cycle is included in which the edge material is dried and cured after application. The apparatus admits of automatic operation at substantial rates of application with virtually no waste or trimming of the edging material after application.

22 Claims, 16 Drawing Figures

APPARATUS FOR APPLYING A COATING TO A WORKPIECE EDGE

CROSS-REFERENCED RELATED APPLICATION

This application is a Continuation-in-Part of copending application Ser. No. 159,783, filed July 6, 1971, entitled EDGING APPARATUS AND METHODS in the name of Irvin Edward Zirbel, now abandoned.

BACKGROUND OF THE INVENTION

1. Field of the Invention

This invention relates to the fabrication and finishing of furniture panels, and more particularly is applicable to the finishing of such panels of a nature which require the application of some type of covering on the edges thereof to conceal the true appearance and to develop the appearance of true solid wood finishes.

2. Description of the Prior Art

Fine woods for furniture panels, desk and countertops, and shelving ar becoming more and more scarce and costly. At the same time, the development of improved techniques in laminating and photoprinting, and the increased availability of wood substitutes such as particleboard and the like have made possible the development of furniture panels and the like which give the appearance across their major surfaces resembling the actual types of wood, such as walnut, mahogany, birch, etc. which they are designed to imitate. One principal remaining problem, however, has been the difficulty in developing a finish for the edges of such imitation or laminated wood panels which can match the appearance of the apparent wood grain of the major surfaces of the panels. Banding strips have been used, but this involves a relatively slow and costly application process involving considerable hand labor to apply and finish the strips along the edges of the wooden panels. Other attempts to provide the desired finish include the use of spraying apparatus with which to apply a liquid which hardens to a base for photoprintingg a grain finish thereon. This approach is generally unsatisfactory, because of overspray problems, the relatively long drying time for the spray coating, and the need for further finishing, such as sanding, trimming and the like.

It is therefore desired to provide a suitable arrangement for developing a desired edge surface on laminated or imitation wood panels and the like in a manner which permits processing on the production line basis with a minimum of finishing steps and time involved in the process.

SUMMARY OF THE INVENTION

In brief, particular arrangements in accordance with the present invention provide for the application of quick drying liquid material which both seals and coats the panel edges with a base coat of precisely controlled minimal thickness which hardens quickly and without the need for further finishing to a smooth base suitable for the imprint of a simulated woodgrain pattern thereon. Methods and apparatus in accordance with the invention involve particular steps in the preparation of the panel edges prior to the application of the liquid material. Following application, the material is passed through a cycle where it is heated and cured under precisely controlled temperatures and at predetermined rates in order to finally prepare the edge surface for final finish imprinting.

In preferred arrangements in accordance with the invention, the material employed is a wood putty or wood dough with a fast-drying liquid which, under the process of the invention, dries to a hard finish in approximately 15 seconds. The liquid material applicator includes a mechanism for both applying the liquid in the desired thickness and rate of flow and for shaping and smoothing the liquid as it is applied to the panel edge. In a typical arrangement, the applicator is mounted in position and the panels to be edge-coated are rapidly moved past the applicator position. As each panel approaches the applicator, its presence and position are detected by control mechanisms which activate the applicator to begin and terminate the application of the liquid material at precisely the proper points where the beginning and end, respectively, of the panel edge are in engagement with the applicator.

Particular arrangements in accordance with the invention utilize preheating apparatus prior to the application of the liquid material in order to improve the drying and curing of the material. A sander may also be employed to true up the edge of the panel and to decrease the porosity and improve the smoothness thereof prior to the application of the liquid material. Following the application of the material, the panel edge is passed through an oven for the application of heat thereto. In one particular arrangement, a pair of strip heaters are employed for this purpose which effects the drying of the material at a controlled rate and temperature during part of the cycle and applies heat at a more elevated temperature for a final curing of the edge material.

In accordance with the invention, one particular arrangement of the applicator utilizes a rotary valve through which the liquid material is extruded under pressure. The apparatus includes upper and lower workpiece guides which ride along the opposite surfaces of the panel adjacent the edge to be coated as the panel is rapidly moved through the applicator apparatus. The applicator is forwardly biased into constant engagement with the edge, and this, together with the upper and lower workpiece guides, prevents the escape of any of the liquid material under pressure, except out of the applicator with the edge portion being coated. The applicator includes a recessed surface or smoothing bar adjacent the point of application of a liquid material and displaced therefrom in the direction of travel of the panel through the applicator apparatus. This smoothing bar is recessed by the intended thickness of the edge coat (approximately 0.005 to 0.010 inches) and both limits the amount of liquid material which may be extruded through the applicator valve and smooths the liquid edge coating to the desired final surface finish.

The material employed for the edge finish as described is viscous liquid which dries extremely rapidly when exposed to air, particularly with the application of a minimal amount of heat. Despite this fact, the applicator apparatus of the present invention is effective in sealing the liquid in the valve mechanism and related storage feed facilities so that no drying or hardening of the material can occur within the mechanism until it is extruded and applied to the panel edges being processed. In one preferred embodiment, the rotary valve mechanism is driven by a rack and pinion gear which in turn is actuated by a double acting cylinder pneumatically driven under the control of electromagnetic solenoid valves which themselves are precisely controlled by sensing switches positioned to detect the leading and trailing edges of an individual panel being coated. The filling material controlled in this fashion is applied so precisely that none of it gets on to the surfaces of the panel adjacent the edge being coated, and only negligible amounts, if any, are permitted to lap around the corners constituting the ends of the edge being coated. For removal of such an overlap, a switch controlled air jet apparatus is provided following the heating oven to literally blow the droplet or nodule off the corner of the panel.

BRIEF DESCRIPTION OF THE DRAWINGS

A better understanding of the present invention may be had from a consideration of the following detailed description, taken in conjunction with the accompanying drawings, in which.

DESCRIPTION OF THE PREFERRED EMBODIMENTS

Figure 1:
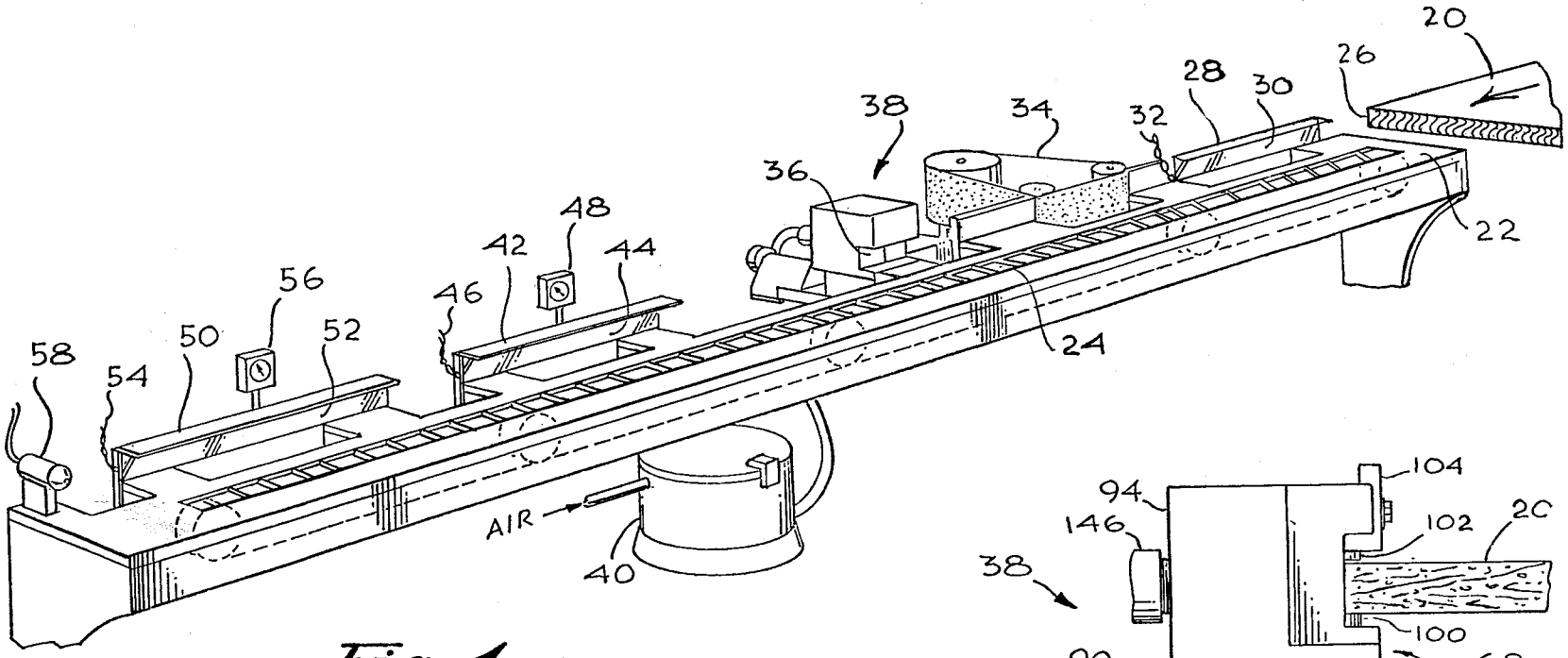
FIG. 1 is a perspective view of edge finishing apparatus according to the invention.

Referring now to the drawings and particularly to FIG. 1, there is illustrated apparatus for finishing the edge of particleboard, plywood and the like. A workpiece 20 which may be particleboard or plywood or the like is fed along a work surface 22 and moved thereon by means of a feed chain 24 operated by suitable drive means (not shown) to feed the workpiece 20 at a uniform speed such as 30 feet per minute. The edge 26 of the workpiece 20 is tensioned into abutting relation with a stock fence 28 which is preheated to approximately 120° F by means of a strip heater 30 connected to a suitable power source (not shown) by means of leads 32. The strip heater 30 heats the edge 26 to remove a portion of the moisture adjacent the edge and also helps in the application of filling material. The edge 26 then passes a conventional belt sander 34 which simultaneously oscillates in a vertical plane with respect to the work surface 22 to reduce the degree of porosity of the edge 26, straighten the edge and remove any tearout from the top and bottom surfaces. Particleboard comes in various densities, the more dense the less edge porosity. The amount of edge sanding will therefor vary with density. The sanding also adds heat to the edge 26 of the workpiece 20 to thereby assist in the edging process. The edge 26 then passes into the jaws 36 of an applicator 38 which is fed filling material through a sealed circuit pressure extrusion filling system 40. The system 40 is air pressure controlled through a piston within the tank, the pressure required being a function of the porosity of edge 26. The applicator 38, which will be discussed hereinafter in detail, is switch controlled by the leading and trailing edges of workpiece 20, and applies a uniform predetermined thickness of filling material to the edge 26 of workpiece 20. The filling material used in the pressure extrusion filling system 40 is a wood putty or wood dough with a fast drying liquid which under the process of the invention dries to a hard finish in approximately 15 seconds.

To assist in the drying process, the processed edge 26 passes in proximity to a drying heater 42 which is heated by a strip heater 44 connected to a suitable power source (not shown) by leads 46 and is controlled by a thermostat 48 to a temperature of about 250° F. The processed edge 26 then passes in proximity to a curing heater 50 which is heated by a strip heater 52 connected to a power source (not shown) by leads 54 and is controlled by a thermostat 56 to a temperature of about 300° F. The leading edge 26 of workpiece 20 then passes an air jet nozzle 58 which is controlled by a switch (not shown) actuated by the leading edge of workpiece 20 to remove the overflow on the front of the panel or workpiece 20. The edge 26 is now sealed and coated with a hard finish which, if desired, can have imprinted thereon a wood grain pattern. It is to be understood that the heating temperatures hereinabove referred to are typical for a workpiece feed rate of 30 feet per minute and the temperatures specified will vary for different feed rates.

Figure 2:
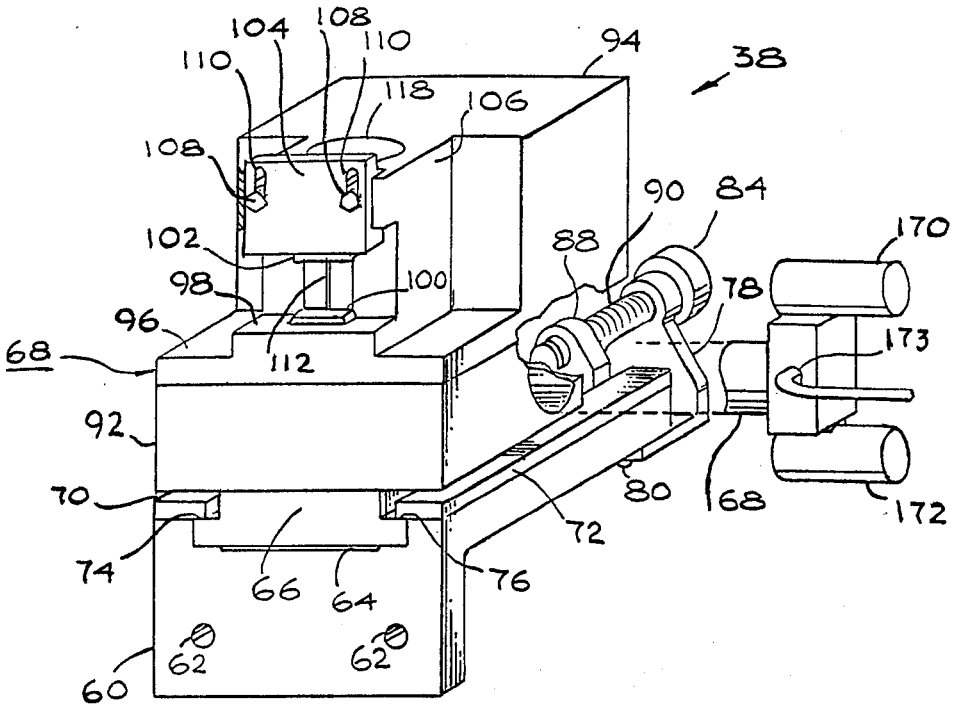
FIG. 2 is a perspective view of the applicator used in the systems of FIG. 1.

Referring now to FIG. 2, there is shown one particular embodiment of an applicator 38 for use with the invention. The applicator 38 has a generally L-shaped base member 60 which is suitably secured with respect to the work surface 22 by means of bolts inserted through apertures 62. The base member 60 has a channel 64 machined in the upper surface thereof which is adapted for slidably receiving an inverted T block 66 at the lower portion of applicator head assembly 68. The inverted T block 66 is restrained within channel 64 by means of bars 70 and 72 secured to base member 60 adjacent channel 64 with the bars 70 and 72 having portions thereof overlapping the shoulders 74 and 76 of the T block 66.

Figure 3:
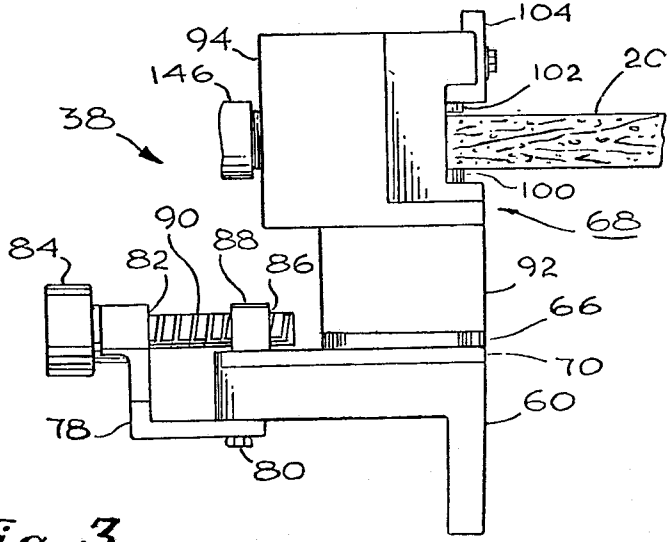
FIG. 3 is a side view of the applicator of FIG. 2.

As better illustrated in FIG. 3, the applicator head assembly 68 is springloaded in a forward direction to maintain constant pressure against the edge 26 of workpiece 20 which is suitably supported and guided at the other edge thereof. Extending rearwardly of base member 60 is a generally L-shaped bracket 78 having one leg thereof secured to the base member 60 by suitable means such as screw 80. The other leg thereof has an aperture 82 through which is inserted an adjusting screw 84, the threaded portion thereof engaging a threaded aperture 86 in a lug 88 integral with a rearwardly extending portion of T block 66. Encircling the shank of adjusting screw 84 is a spring 90 to maintain pressure between lug 88 and bracket 78. By means of this arrangement, the applicator head assembly 68 is constantly biased against edge 26 of workpiece 20 to permit proper tracking and compensate for minor variations in the width of workpiece 20. The adjusting screw 84 is initially preset to the forwardmost anticipated position of the applicator head assembly 68 and thereafter variations in width of workpiece 20 are compensated for by compression of spring 90 between lug 88 and bracket 78.

The applicator head assembly includes a rack housing 92 secured to the inverted T block 66, and a valve housing 94 secured to the rack housing 92. The valve housing 94 has a forwardly projecting base portion 96 having a projection 98 to which is affixed a lower workpiece guide 100 to form part of the jaws 36. Vertically displaced from lower workpiece guide 100 and in line therewith is an upper workpiece guide 102 secured to gauge bar 104 which is secured to valve housing 94 at projection 106 by suitable means such as bolts 108 extending through apertures therein. The workpiece guides 100 and 102 have tapered or rounded edges for guiding the edge of the workpiece therein. The apertures 110 are elongated to provide vertical movement of gauge bar 104 to vary the spacing between workpiece guides 100 and 102 for varying thicknesses of workpiece 20. Alternatively, gauge bar 104 can be spring loaded in the downward direction to account for minor variations in thickness of workpiece 20.

A filling material is metered through a rotary valve which will be hereinafter described through elongate slot 112 between workpiece guides 100 and 102.

Figure 5:
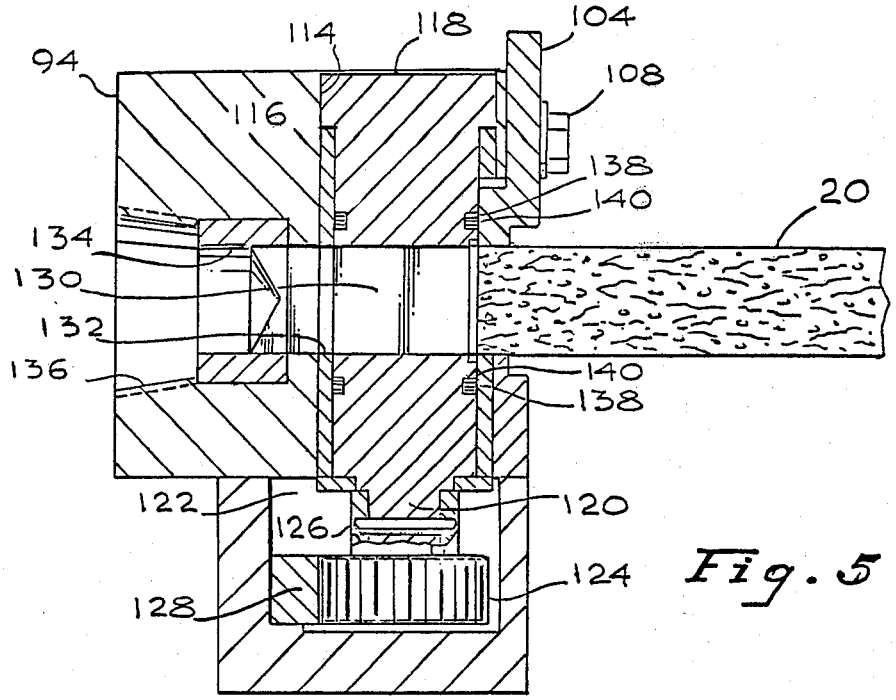
FIG. 5 is a cross-sectional view taken along V—V of FIG. 4.
Figure 7:
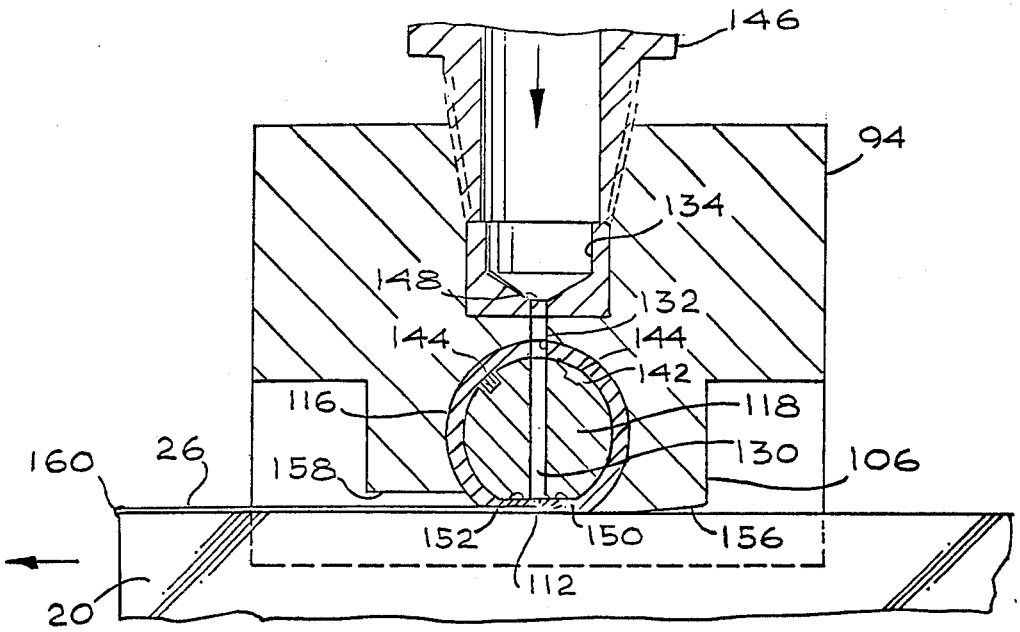
FIG. 7 is a cross-sectional view taken along lines VII—VII of FIG. 4.
Figure 8:
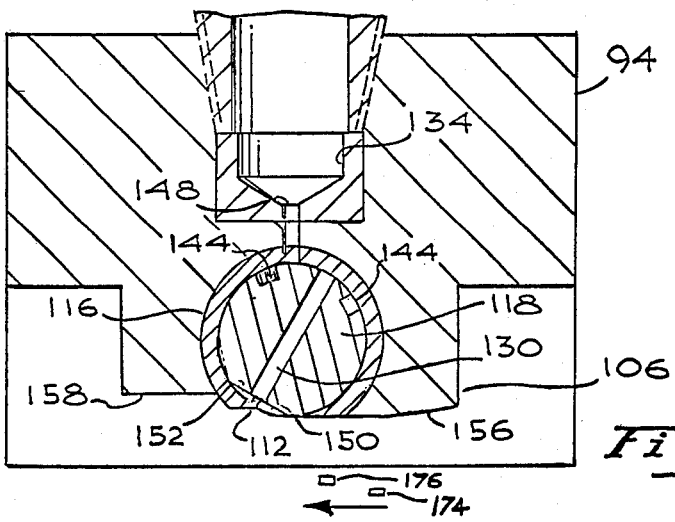
FIG. 8 is a variation of the cross-sectional view of FIG. 7 showing the rotary valve in a closed position.

Referring now to FIGS. 5, 7, and 8, the internal construction of the applicator head assembly will be discussed. As can be seen in FIG. 5, the valve housing 94 has an aperture 114 extending therethrough to fixedly receive a bearing or bushing 116 into which is positioned a rotary valve member 118 having a smaller diameter shaft portion 120 depending therefrom into rack housing cavity 122. The shaft portion 120 of rotary valve member 118 has affixed thereto a gear 124 secured by means of pin 126 extending through the gear hub and shaft 120. Coacting with gear 124 is a rack 128 (see also FIG. 7) to impart limited rotary motion of valve member 118. Adjacent the midportion of valve member 118, there is located a slot 130 extending through the main body of valve member 118 in alignment with upper and lower workpiece guides 100 and 102. The length of the slot 130 would be the same as the maximum thickness of workpiece 20 to which a finished edge is to be applied. The bushing 116 contains therein a slot 132 having a cross-section identical to that of slot 130, both slots being in alignment with an aperture 134 through which the filling material is extruded. The aperture 134 is provided with an internal thread 136 to accept a male hose connector (shown in FIG. 7) for feeding the material from pressurized system 40. Opposite either side of slot 130 the rotary valve member 118 is provided with circumferential grooves 138 containing suitable seals 140 made of leather packing or other similar sealing material. Similarly, as can be seen in FIGS. 7 and 8, the rotary valve member 118 has a pair of axially displaced grooves 142 in the surface thereof on either side of slot 130 containing wiping seals 144. The wiping seals 144 are angularly displaced from slot 130 just beyond positions conforming to the maximum angular rotation of valve member 118.

A given range of thicknesses of workpiece 20 can be handled by one valve member 118. For a different range, the valve housing 94 is removed and replaced by another with a different length for the valve member 118 and orifice 112.

Referring now to FIGS. 7 and 8, the details pertaining to the edge filling will be discussed in detail. The filling material is extruded through male connector 146 through aperture 134 which is tapered and at its exit end contains a slot 148 having the same cross-section as slot 132 in bushing 116 and slot 130 in rotary valve member 118. At the exit end of slot 130, the valve member 118 is milled flat in a direction perpendicular to slot 130. The milled surface has affixed thereto a pair of bars 150 and 152 for providing an elongated slot or orifice 112 of narrower width than slot 130, which increases the flow rate of filling material through the slot thereby filling deeper holes in the edge 26 due to the greater pressure. Bar 150 is provided with an arcuate surface of the same diameter as valve member 118 while bar member 152 has a generally planar external surface being offset from the outermost tip of bar 150 by a distance equal to the thickness of filling material required on the edge 26 of workpiece 20. With reference to the direction of material feed, the projection 106 has a leading edge 156 which is tapered inwardly toward valve housing 94 and a trailing edge 158 which is offset inwardly from the exterior surface of bar 152. The bushing 116 adjacent bar 152 has the edge thereof milled so that the bar 152 and the milled edge form a plane a predetermined distance from the edge 26 of workpiece 20 (in the range of .005 to .010 inches) which corresponds to the desired thickness of filling material to be applied to edge 26. The direction of the feed of workpiece 20 is indicated by the arrow in FIG. 7. Adjacent the leading corner of workpiece 20, there is shown a globule 160 of filling material in an exaggerated form for illustrative purposes. As the workpiece 20 traverses the work surface 22, this globule 160 is blown off by the air jet nozzle 58 (shown in FIG. 1) which can be actuated by a trip switch (not shown) engaged by workpiece 20 at a point just prior to the air jet 58.

As can be seen in FIG. 7, the material is extruded through orifice 112 and the planar surface formed by bar 152 and milled edge of the bushing 116 performs a wiping action as well as a smoothing function of the filling material as it adheres to the edge 26 of workpiece 20. The length of the planar surface must be of a length sufficient to smooth and self-clean. If it is too short, the filling material is not smoothed properly. If it is too long, the material tends to adhere to it and it loses its self-cleaning properties.

Figure 9:
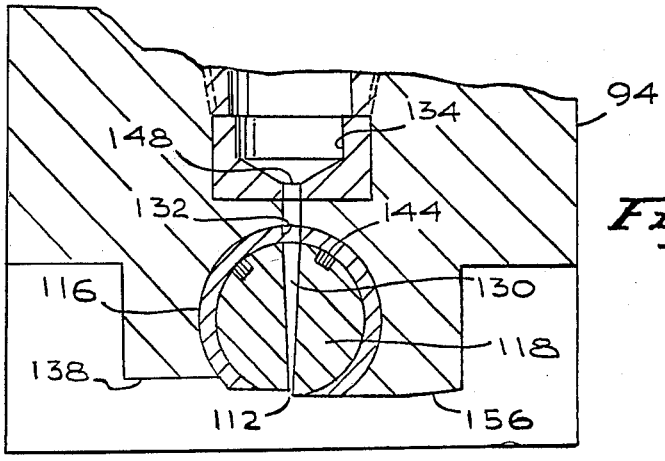
FIG. 9 is a modified version of the valve of FIGS. 7 and 8.

FIG. 8 illustrates the rotary valve 118 in a closed position with the slot 130 at an angle of approximately 30 degrees from its normally open position. As can be seen, the bar 150 is positioned within bushing 116 so that the chamber within slot 130 containing coating material is relatively airtight. Furthermore, even if the chamber is not totally airtight, there is only a small amount of filling material exposed to any air leakage, that is, the filling material contained within orifice 112 and the space between bushing 116 and bar 152. As will hereinafter be discussed, the rotation of valve member 118 is effected just prior to the leading edge of workpiece 20 coming into contact with orifice 112, thereby depositing this minute amount of material on the corner of workpiece 20 to form globule 160 which is subsequently blown off by air jet nozzle 58. An alternative configuration of the valve member 118 is shown in FIG. 9 wherein the slot 130 is tapered from the inlet end to the outlet end to thereby eliminate the need for bars 150 and 152. However, the wiping surfaces and arcuate side of aperture 112 retain the same configuration previously described.

Figure 4:
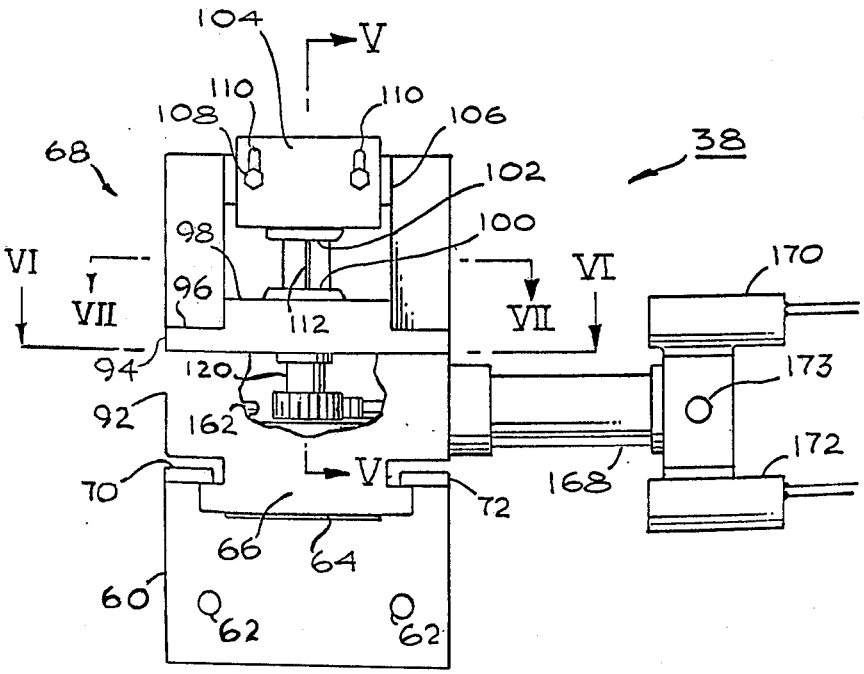
FIG. 4 is a front view of the applicator of FIG. 2.
Figure 6:
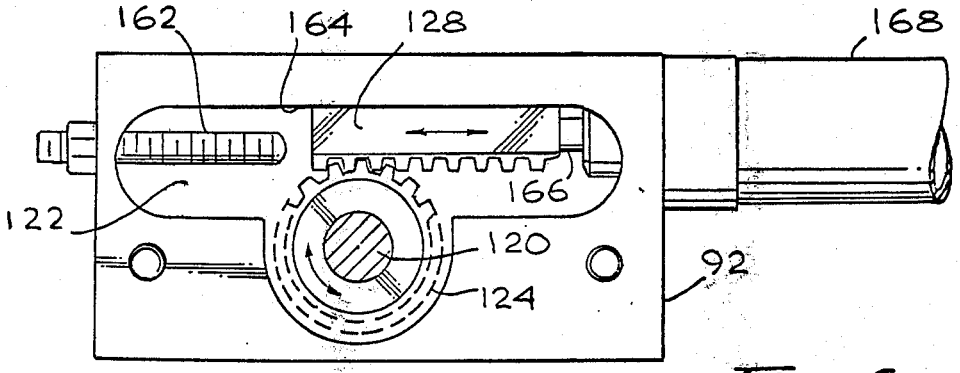
FIG. 6 is a cross-sectional view taken along lines VI—VI of FIG. 4.
Figure 10:
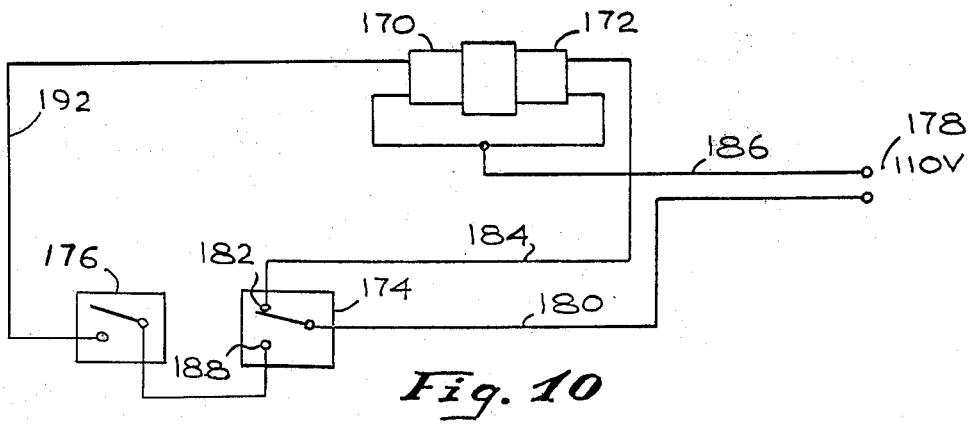
FIG. 10 is a schematic diagram for the circuitry employed to actuate the valve means.

Referring now to FIGS. 4, 6, and 10, the actuating means for rotation of valve member 118 will be described. As shown in FIG. 6, the gear 124 is fixedly secured to a reduced diameter shaft portion 120 of rotary valve member 118 extending into cavity 122 within the rack housing 92. Coacting with gear 124 is a rack member 128 which travels in the direction of the double-ended arrow shown thereon to rotate gear 124 and thereby rotate valve member 118 within a given angular range. The cavity 122 is milled out to provide room for the gear 124, the rack 128 and a stop screw 122 which is aligned with and abuts against the end of rack 128 at the desired limit of its travel. The cavity 122 is provided with a planar surface at 164 which closely abuts the edge of rack 128 to maintain the gear teeth thereof in relationship with the gear teeth of 124. The rack 128 is secured to a piston extension 166 which is pneumatically actuated by an air cylinder 168.

As better illustrated in FIG. 4, the air cylinder 168 is double acting and electrically controlled by a pair of solenoids 170 and 172. The air cylinder 168 is of the type which contains a piston that is actuated in either direction by the selective application of air through air inlet 173 through which air to the piston is controlled by selective energization of solenoids 170 or 172. Once the piston is driven to one extreme by energization of one solenoid, it cannot be returned until that solenoid is denergized and the other solenoid energized. This sequence of electrical energization is depicted in FIG. 10 wherein a pair of trip switches 174 and 167 are provided to selectively apply power from alternating current source 178 to either solenoid 170 or 172. The trip switches 174 and 176 are spring loaded to the position shown in FIG. 10 wherein switch 174 provides an electrical path from alternating current power source 178 through lead 180 through contact 182 through lead 184 to solenoid 172 through common lead 186, this particular path of energization providing air to the piston of air cylinder 168 to close rotary valve member 118.

As shown in FIG. 8, the physical positioning of trip switches 174 and 176 with relation to the workpiece 20 is such that as workpiece 20 approaches the applicator 38, trip switch 174 is physically contacted by the leading edge of workpiece 20, a short distance later trip 176 is encountered by the leading edge of workpiece 20 and a short distance later the edge 26 of workpiece 20 is in contact with the filling material being extruded through orifice 112. The switches 174 and 176 are illustrated in FIG. 8 relative to the orifice 112 with the tripping direction indicated by the arrow. As trip switch 174 is contacted by workpiece 20, switch 174 engages contact 188 to thereby deenergize solenoid 172 and a short time later trip switch 176 is actuated to contact 190 to thereby complete a circuit from power source 178 through lead 180 through contact 188 of switch 174 through contact 190 of switch 176 through lead 192 to solenoid 170 and through common lead 186 to the power source. As the trailing edge of workpiece 20 goes past trip switch 174, the switch is returned to its normal position on contact 182, thereby reenergizing solenoid 172 to close the valve member 118 just prior to the passage of the trailing edge of workpiece 20. Although one switch such as trip switch 174 can be utilized to accomplish the same electrical result by connecting lead 192 to contact 128 of trip switch 174, the purpose of two trip switches is to provide greater flexibility. The trip switches 174 and 176 are physically positioned with respect to each other and with respect to the orifice 112 of applicator 38 (as shown in FIG. 8) so that valve member 118 is opened a predetermined distance prior to the leading corner of workpiece 20 coming in contact therewith to permit extrusion of the material just prior to the corner, while the valve member 118 is closed another predetermined distance just prior to the trailing corner of workpiece 20 so that the extruded material adjacent orifice 154 is wiped over the edge up to the corner without any overflow onto the perpendicular edge. By the use of the two switch system shown in FIG. 8 and FIG. 10, the respective distances of the switches from the orifice 112 can be selectively varied for optimum results at any particular feed rate. This cannot be accomplished with only one switch.

Figure 11:
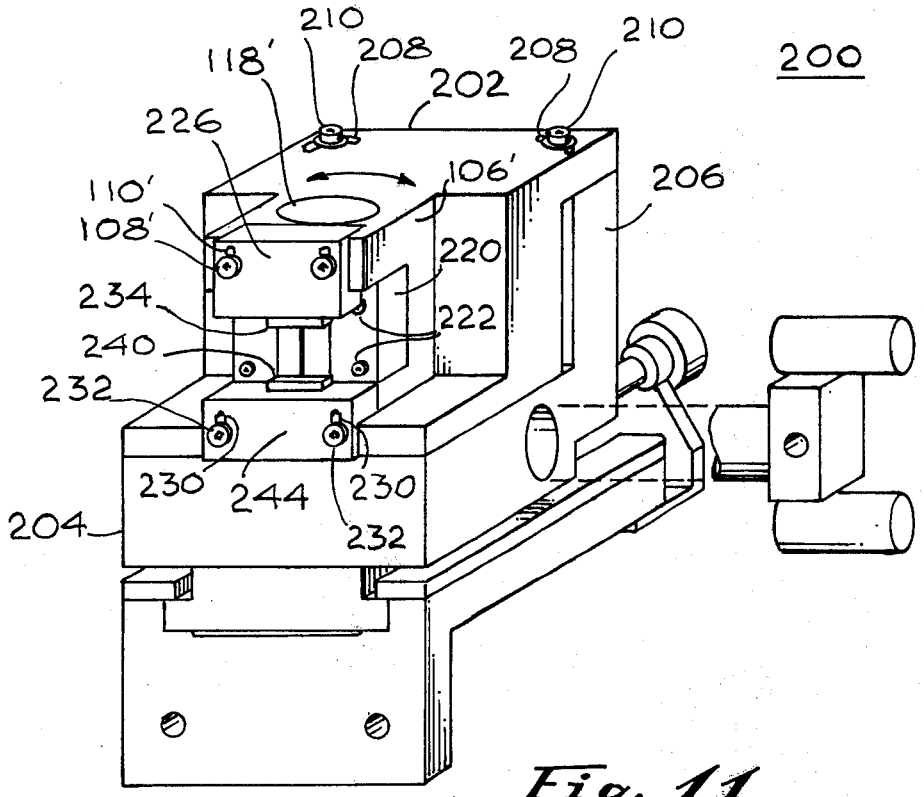
FIG. 11 is a perspective view of an alternativ embodiment of an applicator used in the system of FIG. 1.
Figure 12:
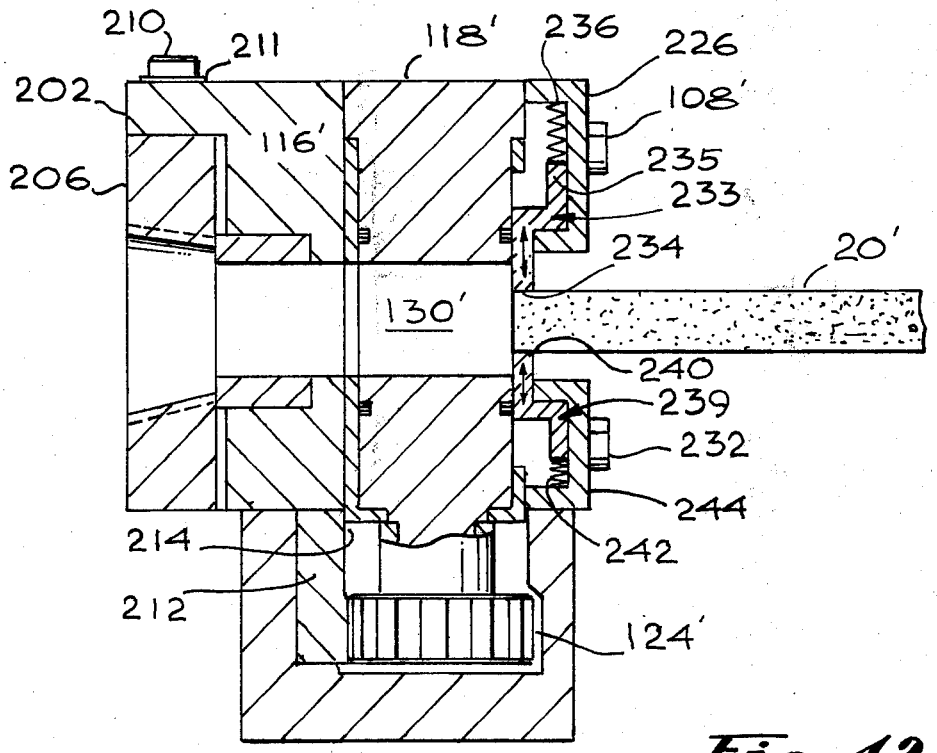
FIG. 12 is a sectional view of the embodiment of FIG. 11 taken to correspond to the sectional view of FIG. 5.

Details of an alternate preferred embodiment in accordance with the invention are shown in FIGS. 11-16. FIGS. 11 and 12 depict the alternative embodiment of the applicator 200 for use in the system of FIG. 1. The views of FIGS. 11 and 12 correspond to FIGS. 2 and 5 depicting the first preferred embodiment. In these figures, the same reference numerals have been used where appropriate, with the addition of a prime symbol to distinguish from the numerals referring to the first preferred embodiment.

Figure 13:
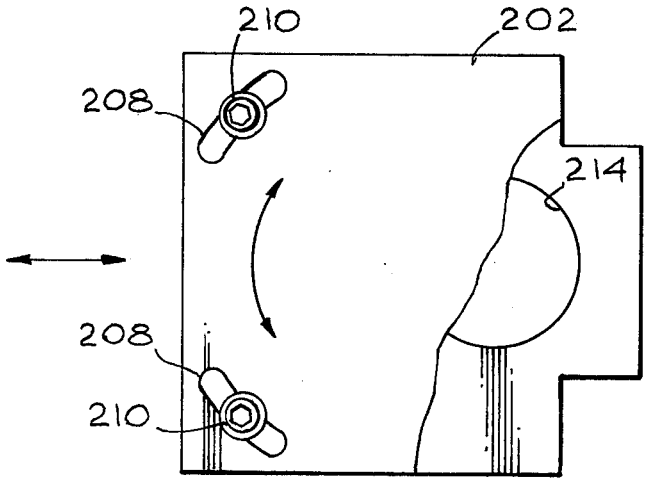
FIG. 13 is a schematic plan view of the embodiment of FIG. 11, partially broken away to show details of operation thereof.

As shown in these figures, the applicator 200 is formed generally to the same configuration as shown and described in connection with FIGS. 2–6 depicting the applicator 38 of the first preferred embodiment, except as noted herein. The rack housing 204 is provided with upwardly extending portions 206 at the rearward corners thereof. The valve housing 202 is shaped with cutouts at the rearward corners thereof to match the portions 206. The valve housing 202 is provided with slots 208 through which fastening bolts 210 extend into the portions 206 to lock the housing 202 in a selected position. As seen in FIG. 12, the lower end of the valve member 118 is provided with a projecting boss 214 which extends into a mating ring 212 shaped to receive and retain the boss 214 for pivotable movement about the center line thereof, thus permitting rotational movement of the valve housing 202 when the bolts 210 are loosened. Thus as is indicated in FIG. 13, the valve housing 202 can be pivoted slightly about the center of the boss 214 within the limits of the slots 208. This permits adjustment of the attitude of the valve housing 202 relative to the direction of travel and orientation of the edge of the workpiece 20 (see FIG. 20) in order to vary the spacing between the edge 26 of the workpiece 20 and the bar 152 and milled edge of the bushing 116. Pivoting the valve housing 202 provides an operational variation of thickness of the filling material on the edge 26 from essentially zero to a range of from 0.010 to 0.020 inches or more, as desired. As indicated in FIG. 13, the valve housing 202 is adjustable about the center line of the boss surface 214 but is also variable in position toward and away from the workpiece 20 in order to accommodate minor width variations due to wrap, improper planing, and the like.

In addition to these variable movements of the valve housing 202 and its associated rack housing, provision is also made to accommodate for variations in the thickness of the workpiece 20. In order to establish the desired edge coating along the edge 26 of the workpiece 20, it is essential that the liquid filling material be prevented from escaping under pressure away from the edge 26 of the workpiece 20 and possibly squeezing out over the upper and lower planar surfaces, as might result from minor variations in the dimensional stability of the workpiece 20. Referring again to FIGS. 11 and 12, it may be seen that upper gage bar 226 is rendered adjustable as to vertical position by means of elongated slots 110' and fastening bolts 108'. Similarly, a lower gage bar 244 is provided which is adjustable in a vertical direction by means of slots 230 and fastening bolts 232. In each of the gage bars 226 and 244 is mounted a vertically movable member to accommodate for the minor variations in thickness of the workpiece 20 as it passes through the applicator housing jaws 36. In the upper gage bar 226, this vertically movable member is designated 233 and has a lower sealing portion 234 and an upper portion 235 which bears against a coil spring 236 which serves to bias the member 233 in the downward direction so that its sealing portion 234 follows the upper surface of the workpiece 20 in sealing relationship to prevent the escape of liquid filler material along the upper planar surface of the workpiece 20. Similarly, the lower gage bar 244 contains a zig-zag member 239 having upper sealing portion 240 and a lower portion 241 bearing against a coil spring 242 which biases the member 239 upward so that the sealing portion 240 bears against the lower planar surface of the workpiece 20, thus preventing the escape of the liquid filler material along the lower planar surface of the workpiece 20. Thus the gage bars 226 and 244 are adjustable in the vertical direction to accommodate workpieces of differing thicknesses within a given range for a particular valve housing, while the sealing portions 234 and 240 of the respective zig-zag members 233 and 239 serve to accommodate minor variations of workpieces of a given nominal thickness to which the gage bars 226, 244 have been set. Moreover, the surfaces of the sealing portions 234, 240 are configured to direct filler material completely across the extent of the edge being coated so as to avoid any undesirable bevelling at the intersections of the edge coating layer with the planar surfaces of the workpiece.

Figure 14:
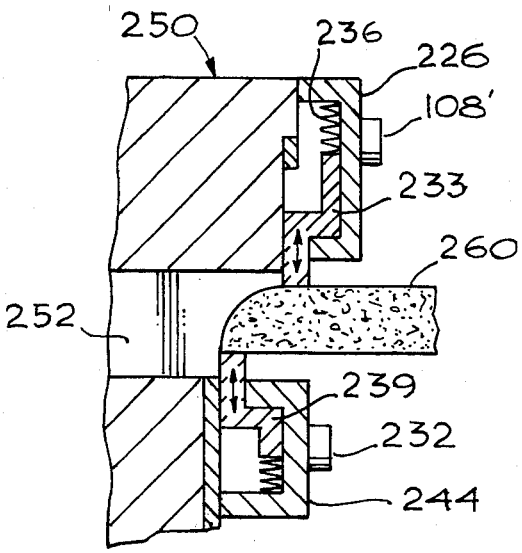
FIG. 14 is a sectional view showing particular structural details of a portion of FIG. 12. modified to effect a particular application of the device.

FIG. 14, in a sectional view corresponding to a portion of FIG. 12, illustrates a particular arrangement for coating a shaped edge surface of the workpiece 20 which is different from the planar edge shown in FIG. 12, for example. In FIG. 14, the workpiece designated 260 is shown with a curved edge shape referred to as a "waterfall" shape. The valve member 250 with its slot 252 is configured to accommodate the curve of the waterfall edge of the workpiece 260. The upper gage bar 226 with its contained zig-zag member 233 and the lower gage bar 244 with its contained zig-zag membr 239 are essentially the same as shown in FIG. 12, except for the vertical displacement of one assembly relative to the other. These respective assemblies are positioned adjacent the upper and lower portions of the slot 252 to provide the desired sealing of the liquid filler material being deposited along the edge of the workpiece 260 as already described. The valve 250 operates in rotary fashion about a vertical axis and therefore is required to be shaped to develop the desired clearance both between the valve 250 and the adjacent edge surface of the workpiece 260 and between the valve 250 and the associated portions of the enclosing guide surface inserts 220 (see FIGS. 11 and 16).

Figure 15:
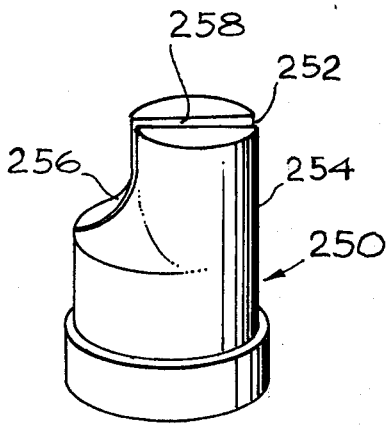
FIG. 15 is a perspective view of a portion of the valve member of FIG. 14, depicted in inverted form for purposes of illustration.
Figure 16:
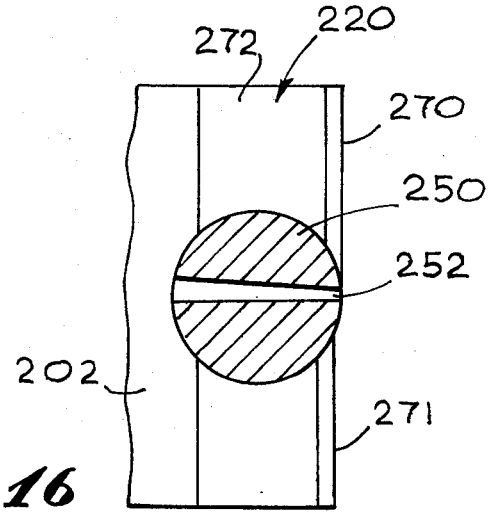
FIG. 16 is a sectional plan view of a portion of the applicator device of FIG. 11, corresponding to the sectional view of FIG. 7.

The upper portion of the central valve member 250 with its enclosed slot 252 is shown in inverted form in FIG. 15. The rearward half of the rotary valve member 250 is the same half cylinder as is depicted for the rotary valve member 118 of FIGS. 7–9, for example. However, the forward portion of the rotary valve member 250 (shown on the left-hand side of FIG. 15) in the vicinity of the slot 252 is configured to accommodate the waterfall shape of the edge of the workpiece 260. Traversing the member 250 in a vertical direction, this surface curves inward in the concave shape to match the waterfall curve. From any point along this curve, proceeding circumferentially about the rotary valve member 250 from the edge of the slot 252, the surface 256 increases radially from the center 258 until it feathers into the constant-radius cylindrical portion 254 extending about the rearward half of the valve member 250 (shown on the right-hand side in FIG. 15). It will be understood that the guide surface inserts 220 which extend about the specially shaped surface 256 of the valve member 250 are configured in mating relationship to provide the desired closure of the valve as it is rotated through the approximately 15° to 30° either side of center between the open and closed positions. They are also configured to match the curved surface of the workpiece edge as the workpiece proceeds past the head assembly. Further, as shown in FIGS. 11 and 16, the guide surface inserts 220 are secured to the valve housing 202 by means of recessed screw fasteners 222 and comprise carbide tip elements 270 and 271 brazed or otherwise suitably secured to the base portions 272 of the guide surface inserts 220. The carbide tips are provided to withstand the severe wear and abrasion occasioned by the abrasive materials (principally the resin binders) which make up the particleboard of the workpiece 20. As these carbide tips 270, 271 wear down in use, the guide surface inserts 220 can be removed and replaced with new elements while the remaining base portions 272 can be refaced with new carbide tips.

It will be appreciated that a wide variety of shapes can be treated by applicator devices in accordance with the present invention through the use of particularly configured rotary valve members 250 and associated guide surface inserts 220. A particular configuration for the waterfall shape is illustrated in FIGS. 14 and 15. Similarly, the operative elements of the rotary valve and associated guide surface inserts can be employed to accommodate a variety of shapes such as the "bullnose," "lip door," "mild O.G. form," and many others. It will be understood that the guide surface inserts 220, such as are shown in FIG. 16, are configured not only to accommodate the shape of the associated rotary valve member 250 and permit its rotation therein between closed and open positions, but also to accommodate the corresponding shape of the surface of the workpiece 260 which is being coated by the applicator device.

Arrangements in accordance with the present invention advantageously complete the missing link in the fully automated process of coating otherwise esthetically unsuitable panel materials with surfaces which may have the appearance of actual wood grains of various types (even including worm holes for simulated antiques) or other finishes as desired, such as stripes, bars, lines, and various patterns as desired. While equipment for coating the major planar surfaces of particleboard, plywood and the like have been available for a long time, apparatus in accordance with the present invention is the first device which presents a capability of providing a type of coating on which a printed finish can be deposited in an acceptable, continuous process. As a result of the use of apparatus in accordance with the present invention described herein, the cost of edge coating is reduced by approximately 90 percent, as compared with the cost of banding the edges of particleboard. Realization of the cost advantages inherent in the use of the applicator of the present invention depend upon providing all of the edge treatment steps in a continuous process performed at various stations in a single machine without separate handling of the boards being treated. The sanding, heating and irradiation steps permit the printing of the intended pattern on the deposited edge of the workpiece almost immediately with further processing thereafter because the board is heated for the drying of the deposited liquid filler material. The applicator head member in accordance with various aspects of the present invention is rendered adjustable to accommodate workpieces of varying widths and thicknesses, with adjustment also being possible to control the thickness of the material being applied to the edge of the workpiece. In addition, different valve heads can be interchangeabley utilized to accommodate varying shapes of the edge of the workpiece, all in accordance with a mechanism to automatically start and stop the flow of the liquid filler material to provide precisely positioned terminations of the applied edge to coincide with the ends of the workpiece being edge-coated.

While there have been shown and described above specific arrangements of edging apparatus and methods in accordance with the invention for the purpose of illustrating the manner in which the invention may be used to advantage, it will be appreciated that the invention is not limited thereto. Accordingly, any and all modifications, variations or equivalent arrangements which may occur to those skilled in the art, should be considered to be within the scope of the invention.

What is claimed is:

1. Apparatus for applying a thin coating of fast-drying filler material to a workpiece edge comprising:

means for defining a confined space adjacent the workpiece edge in which the workpiece edge is removably and movably included as a wall thereof, said confined space having a dimension aligned with the thickness dimension of the workpiece which is equal to said thickness dimension and wherein said defining means include means adjustably variable in the direction of the thickness dimension for establishing said aligned dimension to correspond to the thickness dimension of different workpieces;

means for placing said workpiece adjacent said confined space and developing relative movement between the two;

means for controllably applying the filling material to the confined space including a valve housing and a rotary valve member mounted therein, both being configured in mating relationship to correspond to a selected curved edge of the workpiece and both acting with the defining means to establish said confined space; and means for activating the applying means when the workpiece edge is adjacent the confined space.

2. Apparatus in accordance with claim 1 wherein said activating means includes detecting means positioned to sense the presence of a workpiece adjacent the confined space.

3. Apparatus in accordance with claim 2 wherein the detecting means comprises means for detecting the positions of the leading and trailing edges of the workpiece.

4. Apparatus in accordance with claim 3 wherein said confined space defining means also includes an extended member positioned along the direction of relative travel of the panel edge for smoothing the filling material along the edge as it leaves the confined space.

5. Apparatus in accordance with claim wherein the defining means further includes means resiliently and slidably mounted on the adjustably variable means for maintaining said aligned dimension in correspondence with the thickness dimension of the workpiece over a predetermined range of variations in the thickness dimension within limits established by the setting of the adjustably variable means.

6. Apparatus in accordance with claim 5 wherein said mounted means comprises at least one biased member movable in a direction aligned with the thickness dimension of the workpiece in order to maintain said defining means in sealing contact relationship with the workpiece during its traversal of the confined space.

7. Apparatus in accordance with claim 1 wherein said adjustably variable means includes vertically adjustable thickness gage elements for accommodating workpieces of different nominal thickness dimension.

8. Apparatus for applying filling material to a selected edge of a workpiece, the combination comprising:

valve means selectively configured to match the shape of said selected edge and providing an outlet orifice communicating with an interior opening in said valve means, said orifice having a length which is variable over a range commensurate with the width of the edges to be coated, said orifice having first and second edges configured in accordance with the shape of the selected workpiece edge;

means for extruding edge filling material through said orifice once said valve means are open;

guide means adjacent said orifice including means slidably engaging the upper and lower planar surfaces of the workpiece for confining the flow of filling material to the edge of the workpiece, the slidably engaging means being adjustable along said orifice for varying the length thereof;

means developing relative movement causing traversal of the edge by said member;

means biasing the first edge of said orifice into contact with the edge of the workpiece; and means adjacent the second edge of said orifice to form a shaped surface conforming to the edge of the workpiece at a predetermined distance therefrom to apply the filling material in a thickness generally equal to said predetermined distance.

9. The combination according to claim 8 further including adjustable means for varying said predetermined distance in order to selectively vary the thickness of the layer of filling material applied to the workpiece edge.

10. The combination of claim 8 wherein said means for forming a shaped surface is interchangeable to accommodate different surface shapes to workpieces to be edge-coated.

11. The combination according to claim 8 wherein said valve means is a rotary valve member mounted for rotation in a valve housing and said orifice is integral with the rotating member of said valve, the rotating member and the valve housing being shaped to mate with the shape of the workpiece edge being coated and with each other and spaced from the workpiece edge by the thickness of the edge coating layer being applied.

12. The combination of claim 11 wherein the valve housing comprises removable guide surface inserts positioned along the direction of relative movement of the workpiece on opposite sides of the orifice, said inserts having shaped exterior surfaces corresponding to the shape of the workpiece edge being coated and interior surfaces configured to mate with the shape of the rotary member mounted therein over the range of rotation of the rotary member.

13. The combination according to claim 12 wherein said rotary member comprises a cylindrical surface of constant radius over a major portion of its extent and wherein a portion of said cylindrical surface is shaped with a reduced radius to conform to the shape of the edge of the workpiece being coated.

14. The combination in accordance with claim 11 wherein the rotating member includes a slot extending therethrough with inlet and outlet openings, the outlet opening corresponding to said orifice, and further including sealing means extending about both said inlet and outlet openings.

15. The combination in accordance with claim 14 wherein the rotating member is grooved to receive the sealing means, and the sealing means comprise longitudinal leather strips extending on either side of the slot openings and spaced therefrom by a circumferential distance corresponding to the circumferential travel of the rotating member between open and closed positions, and a pair of leather rings extending on opposite sides of the slot about the circumference of the rotating member and contacting the ends of the leather strips to provide a complete sealing member about each opening.

16. The combination according to claim 11 wherein said rotating member has a shaft portion with a gear secured thereto, said gear coacting with a second gear for actuation of said valve means.

17. The combination according to claim 16 wherein said second gear is a rack gear actuated by a reversible piston.

18. The combination according to claim 17 wherein the piston is controlled to a first position opening said valve means by a first solenoid and to a second position closing said valve means by a second solenoid.

19. The combination according to claim 18 wherein said first and second solenoids are actuated by a pair of trip switches sensing the leading and trailing edges of the workpiece.

20. The combination in accordance with claim 19 wherein the trip switches comprise a first single pole, single throw switch and a second single pole, double throw switch and further including electrical circuit means for connecting the first switch in series with a contact of the second switch and the first solenoid, and connecting another contact of the second switch in series with the second solenoid, whereby said second switch is enabled to deenergize the first solenoid and energize the second solenoid in response to detection of the trailing edge of the workpiece.

21. The combination according to claim 8 including means for sensing the leading edge of the workpiece to actuate said valve means just prior to contact thereof with said orifice.

22. The combination according to claim 21 including means for sensing the trailing edge of the workpiece to deactuate said valve means just prior to the trailing edge passing said orifice.

* * * * *